US006092624A

United States Patent [19]

Slater

[11] Patent Number: 6,092,624

[45] Date of Patent: Jul. 25, 2000

[54] LADDER

[76] Inventor: Carl Slater, 3765 Alonzo Ave., Encino, Calif. 91316

[21] Appl. No.: 09/426,146

[22] Filed: Oct. 22, 1999

[51] Int. Cl.[7] ..... E04G 1/36

[52] U.S. Cl. ..... 182/45; 182/206

[58] Field of Search ..... 182/45, 129, 206

[56] References Cited

U.S. PATENT DOCUMENTS

| | | | |
|---|---|---|---|
| 194,082 | 8/1877 | Falk . | |
| 4,401,184 | 8/1983 | Sherry | 182/45 |
| 4,785,606 | 11/1988 | Burton | 182/45 |
| 5,601,154 | 2/1997 | Eisenmener | 182/45 |
| 5,908,083 | 6/1999 | Hamilton | 182/45 |

FOREIGN PATENT DOCUMENTS

| | | |
|---|---|---|
| 2-115453 | 4/1990 | Japan . |
| 0 117 066 | 8/1984 | United Kingdom . |
| 2 190 420 | 11/1987 | United Kingdom . |
| 2 201 716 | 9/1988 | United Kingdom . |

*Primary Examiner*—Alvin Chin-Shue

[57] ABSTRACT

A ladder for use on roofs, especially steep pitched roofs. The ladder includes a pair of spaced apart elongate rails with a plurality of spaced apart steps extending between the rails. A pair of hooks are coupled to the first ends of the rails. Each of the first sides of the rails has a plurality of skids coupled thereto. A pair of wheels are coupled to the second sides of the rails wheels. A plurality of elongate platform brackets are extended between the rails.

8 Claims, 2 Drawing Sheets

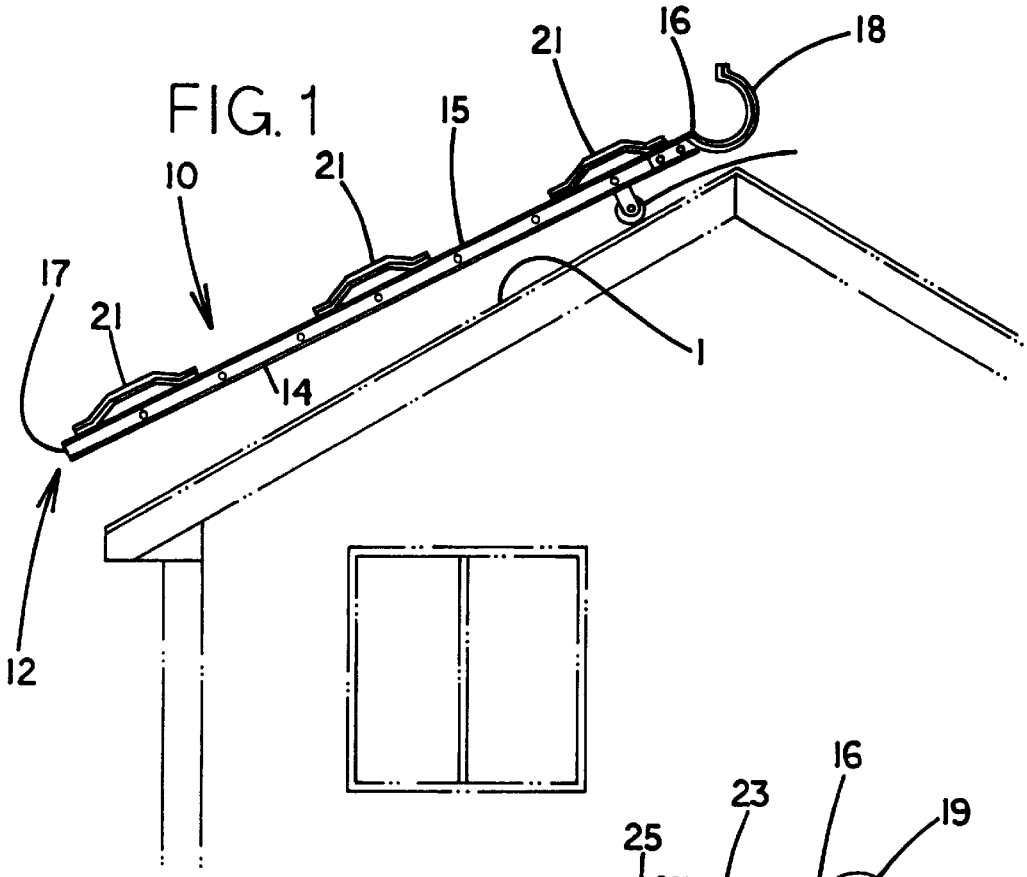
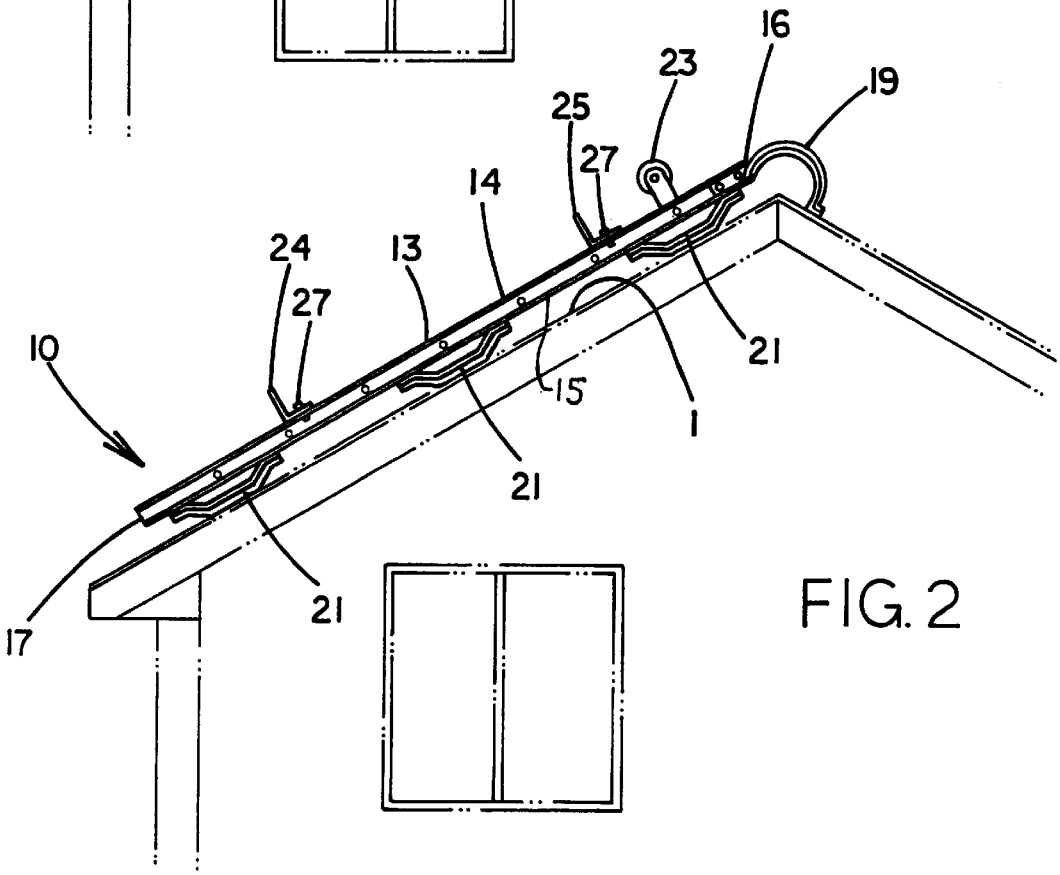
FIG. 2

LADDER

CROSS REFERENCE TO RELATED APPLICATION

This application is a substitute for application Ser. No. 09/105,448, filed Jun. 26, 1998, now abandoned.

BACKGROUND OF THE INVENTION

1. Field of the Invention

The present invention relates to ladders and more particularly pertains to a new ladder for use on roofs, especially steep pitched roofs.

2. Description of the Prior Art

The use of ladders is known in the prior art. More specifically, ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,601,154; U.S. Pat. No. 4,938,312; U.S. Pat. No. 4,232,761; U.S. Pat. No. 4,880,200; U.S. Pat. No. 4,401,184; U.S. Pat. No. 4,009,762; U.S. Pat. No. 4,664,224; U.S. Pat. No. 194,082 and U.S. Pat. No. Des. 307,384.

While these devices fulfill their respective, particular objectives and requirements, the aforementioned patents do not disclose a new ladder. The inventive device includes a pair of spaced apart elongate rails with a plurality of spaced apart steps extending between the rails. A pair of hooks are coupled to the first ends of the rails. Each of the first sides of the rails has a plurality of skids coupled thereto. A pair of wheels are coupled to the second sides of the rails wheels. A plurality of elongate platform brackets are extended between the rails.

In these respects, the ladder according to the present invention substantially departs from the conventional concepts and designs of the prior art, and in so doing provides an apparatus primarily developed for the purpose of use on roofs, especially steep pitched roofs.

SUMMARY OF THE INVENTION

In view of the foregoing disadvantages inherent in the known types of ladders now present in the prior art, the present invention provides a new ladder construction wherein the same can be utilized for use on roofs, especially steep pitched roofs.

The general purpose of the present invention, which will be described subsequently in greater detail, is to provide a new ladder apparatus and method which has many of the advantages of the ladders mentioned heretofore and many novel features that result in a new ladder which is not anticipated, rendered obvious, suggested, or even implied by any of the prior art ladders, either alone or in any combination thereof.

To attain this, the present invention generally comprises a pair of spaced apart elongate rails with a plurality of spaced apart steps extending between the rails. A pair of hooks are coupled to the first ends of the rails. Each of the first sides of the rails has a plurality of skids coupled thereto. A pair of wheels are coupled to the second sides of the rails wheels. A plurality of elongate platform brackets are extended between the rails.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ladder apparatus and method which has many of the advantages of the ladders mentioned heretofore and many novel features that result in a new ladder which is not anticipated, rendered obvious, suggested, or even implied by any of the prior art ladders, either alone or in any combination thereof.

It is another object of the present invention to provide a new ladder which may be easily and efficiently manufactured and marketed.

It is a further object of the present invention to provide a new ladder which is of a durable and reliable construction.

An even further object of the present invention is to provide a new ladder which is susceptible of a low cost of manufacture with regard to both materials and labor, and which accordingly is then susceptible of low prices of sale to the consuming public, thereby making such ladder economically available to the buying public.

Still yet another object of the present invention is to provide a new ladder which provides in the apparatuses and methods of the prior art some of the advantages thereof, while simultaneously overcoming some of the disadvantages normally associated therewith.

Still another object of the present invention is to provide a new ladder for use on roofs, especially steep pitched roofs.

Yet another object of the present invention is to provide a new ladder which includes a pair of spaced apart elongate rails with a plurality of spaced apart steps extending between the rails. A pair of hooks are coupled to the first ends of the rails. Each of the first sides of the rails has a plurality of skids coupled thereto. A pair of wheels are coupled to the second sides of the rails wheels. A plurality of elongate platform brackets are extended between the rails.

Still yet another object of the present invention is to provide a new ladder that has wheels for helping easy installation on a roof.

Even still another object of the present invention is to provide a new ladder that provides a safe structure to users, such roofers and contractors, when working on a roof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side view of a new ladder according to the present invention in use.

FIG. 2 is a schematic side view of the present invention in use with the hooks engaging the roof.

DESCRIPTION OF THE PREFERRED EMBODIMENT

Figure 3:
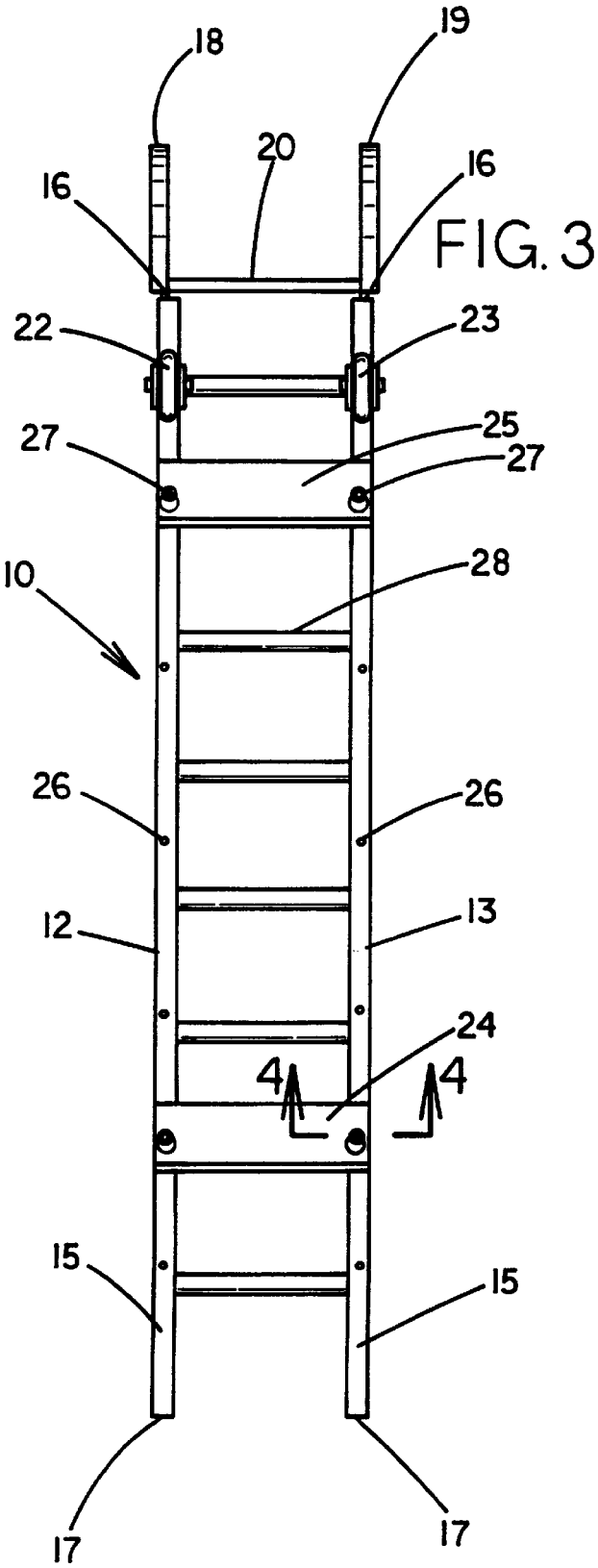
FIG. 3 is a schematic side view of the second side of the present invention.

With reference now to the drawings, and in particular to FIGS. 1 through 4 thereof, a new ladder embodying the principles and concepts of the present invention and generally designated by the reference numeral 10 will be described.

As best illustrated in FIGS. 1 through 4, the ladder 10 generally comprises a pair of spaced apart elongate rails 12,13 with a plurality of spaced apart steps 28 extending between the rails 12,13. A pair of hooks 18,19 are coupled to the first ends 16 of the rails 12,13. Each of the first sides 14 of the rails 12,13 has a plurality of skids 21 coupled thereto. A pair of wheels 22,23 are coupled to the second sides 15 of the rails 12,13 wheels 22,23. A plurality of elongate platform brackets 24,25 are extended between the rails 12,13.

The ladder 10 is designed for use on a roof 1. In closer detail, the elongate rails 12,13 each have opposite first and second ends 16,17 and opposite first and second sides 14,15. A plurality of spaced apart steps 28 are extended between the rails 12,13.

The ladder 10 also includes a pair of hooks 18,19 with each of the first ends 16 of the rails 12,13 having an associated hook 18,19 coupled to it. Each hook 18,19 has a curved portion and terminates at a terminal end. The terminal ends of the hooks 18,19 are outwardly extended away from the first side 14 of their associated rail 12,13 such that the concavity of the curved portion faces away from first side 14 of the rails 12,13. Preferably, the exterior of the hooks 18,19 has a layer of rubber provided thereon for helping prevent slippage of the hooks 18,19 when they mounted to a rook surface as shown in FIG. 2. Preferably, a cross bar 20 is extended between the terminal ends of the hooks 18,19 to help prevent spreading apart of the hooks from one another during use.

Each of the first sides 14 of the rails 12,13 has a plurality of spaced apart skids 21 is coupled to them. The skids 21 are adapted for resting on a surface, such as a roof surface 1.

Preferably, the exterior of the hooks 18,19, the skids 21, and the cross bar 20, all have a layer of a non skid material, such as rubber, provided on them for helping prevent slippage of these elements during their use on a roof 1.

The ladder 10 also includes a pair of wheels 22,23 with each of the second sides 15 of the rails 12,13 coupled to an associated wheel of the pair of wheels 22,23. Preferably, the wheels 22,23 are positioned towards the first end 16 of their associated rail 12,13. The wheels 22,23 are designed for aiding the deployment and removal of the ladder 10 on a roof surface 1 as illustrated in FIG. 1.

Figure 4:
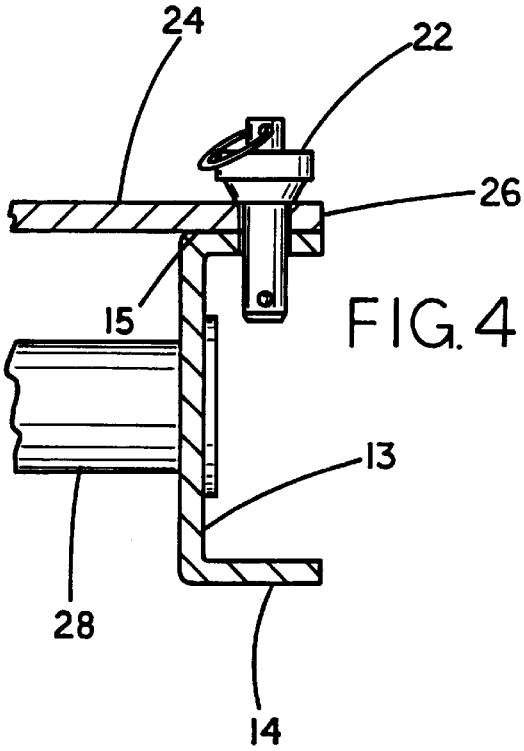
FIG. 4 is a schematic sectional view of the present invention taken from line 4—4 of FIG. 3.

A plurality of elongate platform brackets 24,25 are extended between the second sides 15 of the rails 12,13. Each of the platform brackets 24,25 preferably has a generally L-shaped cross section taken perpendicular to their lengths. The platform brackets 24,25 are designed for resting and mounting objects, such as paint cans and tools thereto, and for resting scaffolding thereon during use of the ladder 10. As illustrated in FIGS. 3 and 4, each end of the platform brackets 24,25 are detachably attachable to the second sides 15 of the rails 12,13. In the preferably, each of the second sides 15 of the rails 12,13 has a plurality of spaced apart holes 26 and each end of the platform brackets 24,25 has a releasable fastener such as a quick release pin 27 which is extended therethrough and into one of the holes 26 on its associated rail to fasten the ends of the platform brackets 24,25 to their associated rail.

In use, as shown in FIGS. 1 and 2, the ladder is deployed on the roof by rolling the wheels on first side of the rails up the roof. When the first ends of the rails approach the peak of the roof 1, the ladder is flipped over to the second sides of the rails so that the hooks engage the roof on the other side of the peak. The skids on second side of the ladder may then be rested the roof. The platform brackets may then be attached to the second sides of the rails.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder, comprising:

a pair of spaced apart elongate rails each having opposite first and second ends, and opposite first and second sides;

a plurality of spaced apart steps being extended between said rails;

a pair of hooks, each said first end of said rails having an associated hook coupled thereto;

a plurality of skids being coupled to each of said first sides of said rails for resting on a surface such that resting said skids on a surface spaces said rails and said steps away from the surface to create a space for receiving a toe portion of a user's foot and thereby to permit a medial portion of a user's foot to engage said rail thereby enhancing the stability of a user standing on said step, one of said skids being mounted on each of said first and second ends of each of said rails, one of said skids being mounted on each of said rails at a middle location thereof for supporting said rail at said middle location, each of said skids comprising a spaced apart pair of arm portions and a cross portion connecting said arm portions together, said arm portions of each of said skids being coupled to said first side of the associated rail such that said arm portions space said cross portion from said rail to permit easy grasping of said rail adjacent said skid;

a pair of wheels, each of said second sides of said rails being coupled to an associated wheel of said pair of wheels, said wheels being for aiding the deployment and removal of the ladder on a surface; and a plurality of elongate platform brackets being extended between said rails, said platform brackets being coupled to said second sides of said rails, each of said platform brackets consisting of an L-shaped cross section with a pair of quick release pins extending through one leg of the L-shaped cross section bracket, said platform brackets being detachably attachable to said second sides of said rails; wherein said second sides of said rails each have a plurality of spaced apart holes therethrough, said holes being arranged in a row on the respective rail extending between the associated first and second ends of the respective rail; and one of said quick release pins of each platform bracket being extended into an associated hole in one of said rails and the other of said quick release pins of each platform bracket being extended into an associated hole in the other rail to fasten the respective platform bracket to said rails.

2. The ladder of claim 1, wherein each said hook has a curved portion terminating at a terminal end, said terminal ends of said hooks being outwardly extended from said first side of their associated rail.

3. The ladder of claim 1, wherein the exterior of said hooks has a layer of a non skid material provided thereon for helping prevent slippage of said hooks when mounted to a roof surface, wherein each of said skid has a non skid outer layer for providing a non slip exterior to said skids when resting on a surface.

4. The ladder of claim 1, wherein said wheels are positioned towards said first end of their associated rail.

5. The ladder of claim 1, wherein said rails and skid lie in a common plane.

6. The ladder of claim 1, wherein each of said cross portion of each of said skids being extended substantially parallel to said first side of the associated rail, and wherein said cross portions of said skids are adapted for resting on a roof surface.

7. The ladder of claim 6, wherein said arm portions of each skid are extended at an acute angle to the associated cross portion of the respective skid.

8. A ladder, comprising:

a pair of spaced apart elongate rails each having opposite first and second ends, and opposite first and second sides;

a plurality of spaced apart steps being extended between said rails;

a pair of hooks, each said first end of said rails having an associated hook coupled thereto, each hook having a curved portion terminating at a terminal end, said terminal ends of said hooks being outwardly extended from said first side of their associated rail, each of said curved portions having for resting on a surface a concavity facing in a direction away from said first side of said rails;

wherein an exterior of said hooks has a layer of a non skid material provided thereon for helping prevent slippage of said hooks when mounted to a roof surface;

a cross bar being extended between said terminal ends of said hooks;

a plurality of skids being coupled to each of said first sides of said rails for resting on a surface such that resting said skids on a roof surface spaces said rails and said steps away from the surface to create a space for receiving a toe portion of a user's foot and thereby permit a medial portion of a user's foot to engage said rail thereby enhancing the stability of a user standing on said step, one of said skids being mounted on each of said first and second ends of each of said rails, one of said skids being mounted on each of said rails at a middle location thereof for supporting said rail at said middle location;

each of said skids comprising a spaced apart pair of arm portions and a cross portion connecting said arm portions together, said arm portions of each of said skids being coupled to said first side of the associated rail such that said arm portions space said cross portion from said rail to permit easy grasping of said rail adjacent said skid;

said cross portion of each of said skids being extended substantially parallel to said first side of the associated rail, said cross portions of said skids being adapted for resting on a roof surface;

said arm portions of each skid being extended at an acute angle to the associated cross portion of the respective skid;

wherein each of said skids has a non skid outer layer for providing a non slip exterior to said skids when resting on a surface;

a pair of wheels, each of said second sides of said rails being coupled to an associated wheel of said pair of wheels, said wheels being positioned towards said first end of their associated rail, said wheels being for aiding the deployment and removal of the ladder on a roof surface;

a plurality of elongate platform brackets being extended between said rails, each of said platform brackets consisting of an L-shaped cross section with a pair of quick release pins extending through one leg of the L-shaped cross section bracket, said platform brackets being detachably attachable to said second sides of said rails;

wherein said second sides of said rails each have a plurality of spaced apart holes therethrough, said holes being arranged in a row on the respective rail extending between the associated first and second ends of the respective rail; and one of said quick release pins of each platform bracket being extended into an associated hole in one of said rails and the other of said quick release pins of each platform bracket being extended into an associated hole in the other rail to fasten the respective platform bracket to said rails.

* * * * *